US007942405B2

(12) United States Patent
Sonnack et al.

(10) Patent No.: US 7,942,405 B2
(45) Date of Patent: May 17, 2011

(54) MAIL PROCESSING MACHINE FOR CONVEYING FILLED ENVELOPES

(75) Inventors: Dieter Sonnack, Hungen (DE); Eddy Edel, Friedberg (DE); Wolfgang Hartl, Alsfed (DE); Thomas Denzinger, Alzenau (DE)

(73) Assignee: Pitney Bowes Inc., Stamford, CT (US)

( * ) Notice: Subject to any disclaimer, the term of this patent is extended or adjusted under 35 U.S.C. 154(b) by 1664 days.

(21) Appl. No.: 11/031,649

(22) Filed: Jan. 7, 2005

(65) Prior Publication Data

US 2005/0189691 A1 Sep. 1, 2005

(30) Foreign Application Priority Data

Jan. 8, 2004 (DE) ..... 10 2004 001 365

(51) Int. Cl.
*B65H 29/00* (2006.01)

(52) U.S. Cl. ..... 271/186; 271/2; 271/303; 271/187; 198/408; 198/412

(58) Field of Classification Search ..... 271/2, 298, 271/303, 184, 185, 187, 656, 657, 900, 659; 198/400, 408, 409, 412
See application file for complete search history.

(56) References Cited

U.S. PATENT DOCUMENTS 3,222,056 A * 12/1965 Lyon ..... 271/2
3,606,951 A 9/1971 Sather et al.
3,994,221 A * 11/1976 Littleton ..... 101/227
4,162,733 A * 7/1979 Wiseman ..... 414/790.4
4,705,157 A * 11/1987 Bowles ..... 198/405
5,012,915 A * 5/1991 Kristola et al. ..... 198/411
5,201,399 A * 4/1993 Dietrich ..... 198/409
5,368,287 A * 11/1994 Belec et al. ..... 271/185
5,411,250 A * 5/1995 Belec et al. ..... 271/185
5,485,989 A * 1/1996 McCay et al. ..... 271/2
5,975,514 A 11/1999 Emigh et al.
6,398,204 B1 * 6/2002 Keane et al. ..... 271/2
6,793,212 B2 * 9/2004 Holbrook ..... 271/2
2005/0167903 A1 * 8/2005 Hartl et al. ..... 271/2
2005/0190184 A1 * 9/2005 Brauneis et al. ..... 345/428

FOREIGN PATENT DOCUMENTS

DE 19943759 C1 2/2001

* cited by examiner

*Primary Examiner* — Stefanos Karmis
*Assistant Examiner* — Gerald W McClain
(74) *Attorney, Agent, or Firm* — Michael J. Cummings; Charles R. Malandra, Jr.

(57) ABSTRACT

In a mail processing machine, a fixed mounting of an envelope turning station relative to an upstream stuffing station, and therefore a simple construction of the drive for the envelope turning station, can be achieved in that the items of goods for despatch to be turned through 180° are drawn by grippers of a gripper chain into the region of horizontally opening tongs of the envelope turning cylinder of the envelope turning station, in such a way that, in each case irrespective of the longitudinal format of the items of goods for despatch, the latter are gripped by the turning cylinder tongs over their entire length, for which purpose the gripper chain, together with the stuffing table supporting it, is designed to be displaceable with respect to the turning station in the conveying direction of the goods for despatch, in a manner dependent on the envelope format.

10 Claims, 2 Drawing Sheets

MAIL PROCESSING MACHINE FOR CONVEYING FILLED ENVELOPES

Figure 1:
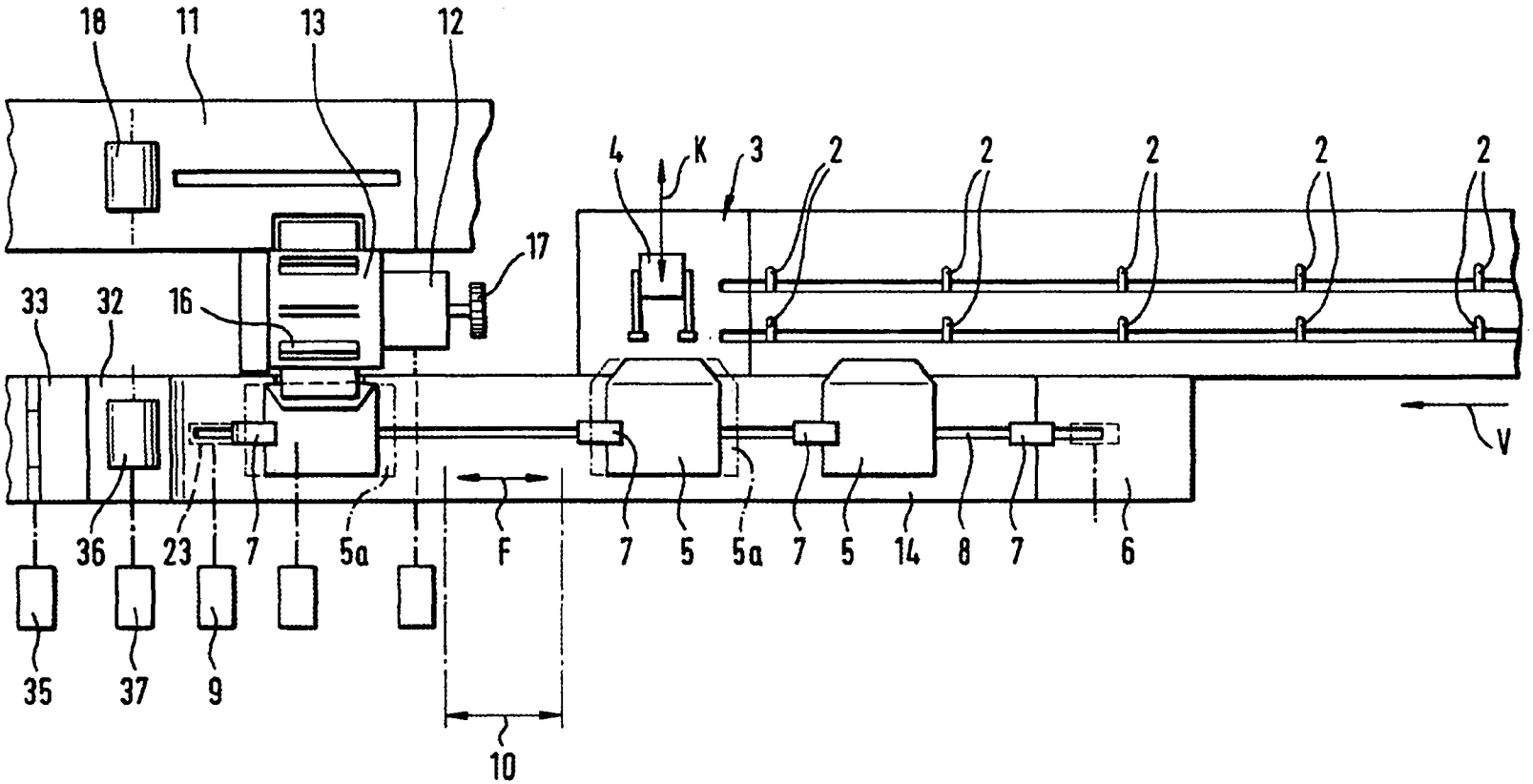

The invention relates to a mail processing machine having an envelope turning station which operates cyclically, is connected downstream of a stuffing station and an envelope closing section in the conveying direction of the goods for dispatch and which has a turning cylinder which is accordingly set rotating cyclically, whose axis of rotation is oriented parallel to the conveying direction of the goods for dispatch and which, on its circumference, bears tongs which can be actuated in an open position and in a closed position as a function of the rotational position of the envelope turning cylinder and into which, by means of an intermittently driven gripper chain and with the tongs opened horizontally, filled envelopes as goods for dispatch can be conveyed from the envelope closing section and from which, following the closure of the tongs and rotation of the envelope turning cylinder through 180°, envelopes can be conveyed away again with an address field side or envelope window side pointing upwards.

Such mail processing machines, which have been on the market for some, time, contain in the envelope turning station a turning cylinder mechanism whose construction is known to those skilled in the art, in which, close to the circumference of the turning cylinder, strip-like or leaf-like tongs parts which are elongated in the direction of the turning cylinder axis of rotation and in the direction of conveyance of the goods for dispatch are mounted about pivot axes that are parallel to the turning cylinder axis of rotation and, via links and sensing rollers, can be pivoted into the open position and into the closed position counter to spring prestress by means of stationary slotted guides during the rotation of the turning cylinder. This mechanism is known to those skilled in the art in this field and therefore does not require any more detailed discussion in the present description and in the claims.

If, in the known mail processing machines of the type described briefly at the beginning, items of goods for dispatch having a different longitudinal format in relation to the conveying direction of the goods for dispatch are to be processed and, in particular, are to be turned in the envelope turning station, in order that the tongs of the envelope turning cylinder do not miss the longitudinal edge of the goods for dispatch or of the filled envelope adjacent to its axis of rotation, it is necessary for the position of the envelope turning station to be coordinated with the respective longitudinal format of the goods for dispatch, that is to say the envelope turning station therefore has to be moved closer in the direction of the stuffing station and the envelope closing section for smaller longitudinal formats or, in the case of larger longitudinal formats, goods for dispatch that are to be processed must be moved further away from the stuffing station and the envelope closing section.

This setting of the mail processing machine in order to take account of the longitudinal format of the items of goods for dispatch, by moving the turning station together with the stuffing table, complicates the construction of the envelope turning station and its support and the construction of the drive for the envelope turning cylinder.

Accordingly, it is an object of the present invention to simplify the construction relating to setting a mail processing machine of the type defined in the precharacterizing clause of claim 1 in the region of the envelope turning station to different longitudinal formats of the items of goods for dispatch to be handled, and to simplify and cheapen the construction of the envelope turning station and its drive.

According to the invention, this object is achieved by the features specified in the characterizing part of claim 1.

Advantageous refinements and developments of the mail processing machine specified here are the subject-matter of patent claims subordinate to claim 1, whose content is hereby expressly made a constituent part of the description without repeating the wording at this point.

Figure 2:
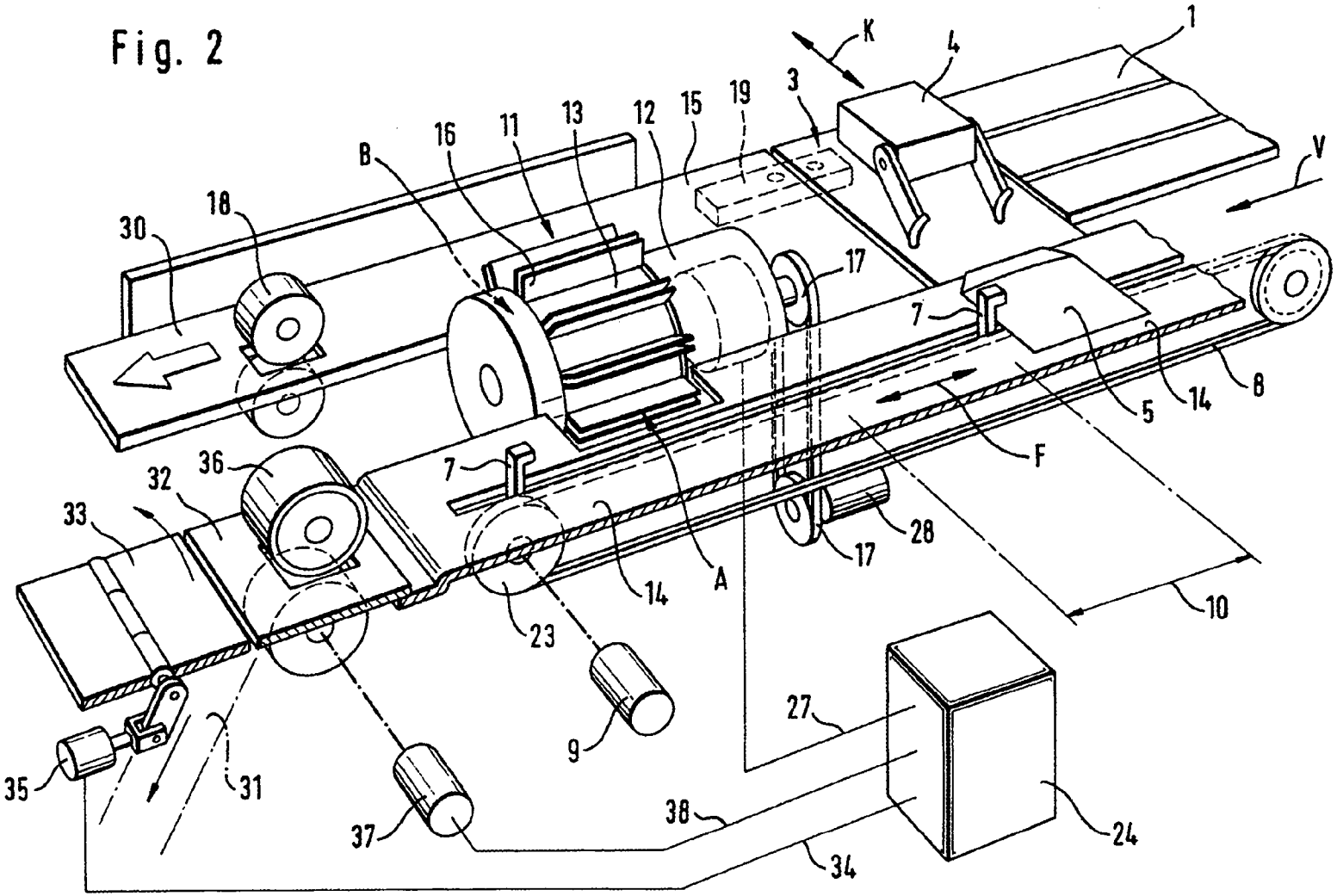

In the following text, an exemplary embodiment will be explained in more detail with reference to the drawing, in which:

FIG. 1 shows a schematic elevation of a mail processing machine of the type specified here; and FIG. 2 shows a schematic perspective view of the front end, in the conveying direction of the goods for dispatch, of the mail processing machine according to FIG. 1 in the region of the stuffing station, the closing section and the envelope turning station.

FIG. 1 shows an insert collating track 1, along which the upper runs of circulating, endless conveyor chains or conveyor belts are guided, which are fitted with conveyor fingers 2, pairs of conveyor fingers 2, which are here located beside one another in accordance with the arrow V in relation to the conveying direction of the goods for dispatch, in each case defining in front of themselves insert conveying compartments, into which inserts can be inserted in a known way by means of insert discharge stations lined up in a row along the insert collating track, so that, ultimately, at the front end of the insert collating track 1, a complete set of inserts to be put into an envelope is assembled in each conveying compartment.

The conveyor fingers 2 moved by the conveyor chains or conveyor belts along the insert collating track 1 transfer the sets of inserts from the insert collating track 1 to a stuffing station 3, from which, in a drive pause of the conveying fingers 2, the sets of inserts are inserted into envelopes 5 provided open opposite the insertion apparatus 4 in an operating stroke oriented parallel to the double arrow K, transversely with respect to the conveying direction of the goods for dispatch, by means of an insertion apparatus 4.

The envelopes 5 from an envelope supply are separated in an envelope feeder station 6 and, with the envelope flap in the open position, are inserted horizontally into grippers 7 belonging to an endless, cyclically or intermittently driven gripper chain 8 running beside the insert collating track 1 and parallel to the latter, after which the grippers 7, controlled by slotted guides, grip the edge of the envelope leading in the conveying direction of the goods for dispatch, and the envelope is then drawn as far as a position in front of the insertion apparatus 4 in movements of the circulating gripper chain 8 corresponding to the cycle rate. The gripper chain 8 is laid over sprockets, of which a driven sprocket is indicated at 23. The sprockets are mounted and supported on a stuffing table or can be displaced in the direction of the double arrow F with respect to the stuffing station 3 and the insert collating track 1 by means of a drive, not illustrated.

Depending on the format of the envelope or item of goods for dispatch to be processed, the gripper chain 8 is brought into appropriate positions by controlling the longitudinal displacement drive of the stuffing table, so that the set of inserts assembled in the insert conveying compartments can be inserted properly into the filled envelope 5 by the insertion apparatus 4 of the stuffing station 3, which is done during brief opening of the gripper 7 holding the envelope 5 to be filled in the stuffing station. The relevant gripper 7 is then closed again and pulls the now filled envelope, that is to say the item of goods for dispatch, out of the stuffing station 3 over an envelope closing section, indicated only symbolically at 10 in the drawing figures, for closing the envelope flap by turning it over onto the upwardly pointing rear wall of the envelope, into the envelope turning station designated generally by 11.

In the latter, the gripper 7 clamping the filled envelope is opened in the respectively desired position after the gripper chain 8 has been stopped on account of the longitudinal format-dependent displacement, carried out previously, of the stuffing table together with the gripper chain unit, after which the gripper chain 8 is started up again in order to pull the gripper 7 away from the filled envelope, that is to say from the item of goods for dispatch, and to release the envelope to be handled by the tongs of the envelope turning cylinder, as will be described in more detail in the following text.

The envelope turning station 11 contains an envelope turning apparatus 12 having an envelope turning cylinder 13 which can be set rotating at the cycle rate and which can be rotated about an axis of rotation that is parallel to the conveying direction of the goods for dispatch, corresponding to the arrow V, this axis of rotation being placed approximately in that plane which is defined by the surface of the stuffing table 14 and of the turning table for the goods for dispatch, designated by 15.

As soon as a pair of strip-like or leaf-like turning cylinder tongs parts 16 extending radially outwards from the turning cylinder circumference substantially in axial planes in relation to the turning cylinder axis of rotation come into the horizontal position identified by A in FIG. 2, they are brought into the open position by means of slotted guide control, as was described briefly at the start for known turning cylinder constructions, so that the free space between the open tongs is located substantially above the level of the envelope turning table 15, and a filled envelope can be pulled by gripper tongs 7 between the turning cylinder tongs 16 located in the position A, with its longitudinal edge lying close to the cylinder axis of rotation.

Then, if the turning cylinder 13 is set rotating by a drive mechanism indicated generally at 17, the turning cylinder tongs located in the position A close, grip the filled envelope pulled into them and, following the rotation of the turning cylinder 13 through 180° in the anticlockwise direction with respect to the situation shown in FIG. 2, deposit it on the envelope turning table 15 in a horizontal position B, in such a way that the closed envelope flap now comes to lie pointing downwards, and an address area side or envelope window side of the filled envelope points upwards. In the position B, the relevant turning cylinder tongs are opened again, so that the envelope turned and deposited on the envelope turning table 15 can now be conveyed away by an envelope onward conveying apparatus indicated schematically at 18.

It can be seen from FIG. 2 that, in the embodiment shown here of a mail processing machine of the type specified here, the envelope turning table 15 is fixed to a frame indicated schematically at 19 and belonging to the mail processing machine, just like the stuffing station 3. The envelope turning station 11 and its envelope turning cylinder 13 are therefore mounted on the mail processing machine in a stationary manner with respect to the stuffing station 3 in relation to the conveying direction of the goods for dispatch, corresponding to the arrow V.

If, by using the mail processing machine, sets of inserts and envelopes with a longitudinal format which is different from a standard size are to be processed in the direction of the conveying direction of the goods for dispatch, corresponding to arrow V, that is to say, for example, having a greater longitudinal format, as is made clear in FIG. 1 for envelopes 5*a* indicated by dash-dotted lines, care must be taken that the tongs 16 of the turning cylinder 13 always grip the filled envelope, that is to say the item of goods for dispatch, reliably in the holding position A. According to the construction specified here, this is achieved not, for example, by the entire turning station being designed to be displaceable with respect to the upstream processing stations of the mail processing machine, but by the cyclically driven gripper chain 8, with its grippers 7, pulling filled envelopes so far into the envelope turning station 11 that the filled envelopes can be gripped reliably by the tongs 16 of the turning cylinder irrespective of the envelope longitudinal format in relation to the conveying direction of the goods for dispatch, which is ensured by the aforementioned displacement of the stuffing table 14, with the gripper chain unit mounted thereon, in a manner dependent on the longitudinal format of the goods for dispatch.

The gripper is then opened and, by means of the gripper chain 8, is pulled off the filled envelope, which is then gripped by the tongs 16 of the envelope turning cylinder 13 and turned over through 180° into the position B by the latter.

A drive sprocket 23 of the gripper chain 8, which is not shown in detail in the drawing, is coupled via a clutch that can be actuated under control to a continuous drive output of the drive system of the mail processing machine or, according to a preferred embodiment, can be coupled to an intermittent drive output of the drive system of the mail processing machine, in order in the manner just described to continue the transport of a filled envelope into the envelope turning station 11 until the tongs grip the filled envelope to be turned over their entire length on the longitudinal edge adjacent to the envelope turning cylinder axis of rotation, the said envelope projecting to a different extent beyond the ends of the tongs 16 in the conveying direction of the goods for dispatch, depending on the longitudinal extent.

In FIGS. 1 and 2, the drive for the gripper chain 8 is indicated symbolically at 9 and contains the mechanical drive connection to the drive system of the mail processing machine and, if appropriate, also a clutch that can be activated under control for one of the embodiments previously mentioned or else a selectively controllable, separate drive, according to a third but less preferred embodiment.

A signal line 27 leads control signals from a control device 24 to a clutch that can be actuated under control and belongs to the drive member of the envelope turning cylinder 13, the envelope turning cylinder drive being coupled, via the toothed belt drive or chain drive 17 already mentioned previously, directly to a continuously revolving main shaft 28 of the drive system of the mail processing machine. It can be seen that, advantageously, this drive connection of the envelope turning cylinder 13 to the main shaft 28 of the drive system of the mail processing machine does not have to have any capability of displacement of this drive device in order to adjust to different envelope longitudinal formats, which simplifies and cheapens the construction of the drive for the envelope turning cylinder considerably.

The control device 24 therefore supplies control signals via the signal line 27 to the clutch that can be actuated under control belonging to the drive of the envelope turning apparatus 12, in order to move the tongs 16 of the latter through 180° from the position A into the position B in the anticlockwise direction in relation to the illustration of FIG. 2 at quite specific times, it being possible for this rotational movement also to be carried out in a number of steps, in order to fill a plurality of tongs 16 provided on the circumference of the turning cylinder 13 with items of goods for dispatch.

The control device 24 can either be programmed as a function of the longitudinal formats of the items of goods for dispatch to be processed, in such a way that it performs the appropriate control of the longitudinal displacement of the stuffing table 14. However, the control device 24 can also be controlled by sensor sensing signals which register the movement of the items of goods for dispatch and also their formats.

The outward delivery apparatus 18 can also be actuated cyclically by control signals from the control device 24, in such a way that items of mail for dispatch inserted into the outward delivery channel 30 after being turned can be conveyed away, for example by means of interacting rollers and conveyor belts, as soon as the tongs 16 of the turning cylinder 13 have been opened again in the position B.

The bottom of the outward delivery channel 30 can contain a deflection plate which can be opened under control in order to divert an item of goods for dispatch to be separated out into a diverter channel. In the embodiment illustrated in FIG. 2, however, such a diverter channel 31 is provided in the region of an outward delivery channel 32, the diverter channel 31 being closed by a deflection plate 33, which can be moved into the open position by means of a drive 35 that can be controlled by the control device 24 via a signal line 34, so that items of goods placed in an envelope and moved along the outward delivery channel 32 by an outward delivery apparatus 36 can be deflected into the diverter channel 31.

The outward delivery apparatus 36 can be started up as required by the control device 24 via a signal line 38 by means of a drive 37.

If a monitoring device or a sensor device from upstream processing stations of the mail processing machine reports that a filled envelope, for example, does not contain the required number of inserts or contains wrong inserts, then the relevant item of goods for dispatch must be separated out and deflected away via the diverter channel 31. In this case, when such a feedback signal occurs, the control device 24 controls the controllable clutch of the turning cylinder drive 12 via the signal line 27 in such a way that, after a filled envelope has been conveyed in between the tongs of the turning cylinder 13 in the position A of the tongs, the turning cylinder is not set rotating, so that the tongs remain open. The gripper chain 8 is then started up by means of appropriate control signal output via the line 25 to the drive 9, so that that gripper 7 which has conveyed the wrongly filled envelope into the envelope turning station, after moving through into the release position, then moves away from the faulty envelope and sinks below the level of the envelope turning table, and the next gripper 7 with its end formed as conveying fingers pushes the faulty envelope out between the tongs 16 of the turning cylinder, which have remained open, and conveys it to the outward delivery apparatus 36, which is then started up by the drive 37 on the basis of appropriate application of signals via the line 38. That gripper 7 which has performed the action of pushing the faulty envelope or wrongly filled envelope through and out between the tongs 16 of the turning cylinder 30, which have remained open, can already again be one which pulls a properly filled envelope into the turning station 11. After separating out a faulty item of goods for dispatch, the control device 24 returns to the regular control rhythm again, in which filled envelopes are turned through 180° in the turning station 11.

The invention claimed is:

1. Mail processing machine, comprising:

an envelope stuffing station comprising an envelope stuffing table;

an envelope closing section;

an envelope turning station downstream of the envelope stuffing station and the envelope closing section, the envelope turning station comprising:

an envelope turning table;

an envelope turning cylinder; and a plurality of tongs disposed on a circumference of the envelope turning cylinder, the tongs being actuable between an open position and a closed position as a function of a rotational position of the turning cylinder; and an intermittently driven gripper chain comprising a plurality of grippers for gripping respective filled envelopes and conveying the filled envelopes from the envelope closing section in a conveying direction, wherein the gripper chain is adjustably displaceable with respect to the envelope turning station parallel to the conveying direction such that the grippers pull respective filled envelopes of different lengths into the envelope turning station to such an extent that the tongs of the turning cylinder grip respective filled envelopes irrespective of the envelope length, after which the grippers release the envelopes and, by means of the gripper chain, are pulled off the envelopes, each of which is then turned through 180° by the envelope turning cylinder and deposited onto the envelope turning table.

2. Mail processing machine according to claim 1, wherein a drive sprocket driving the gripper chain is coupled to an intermittent drive output of a drive system of the mail processing machine.

3. Mail processing machine according to claim 1, further comprising a control device connected to a drive for displacement of the envelope stuffing table, together with the gripper chain supported by the envelope stuffing table, parallel to the conveying direction, as a function of the length of the envelope, wherein control signals or setting signals corresponding to the envelope length are applied to the control device.

4. Mail processing machine according to claim 1, wherein a drive member of a clutch that is actuated under control and belongs to the envelope turning cylinder is coupled directly, via a toothed belt drive or chain drive, to a continuously revolving main shaft of a drive system of the mail processing machine.

5. Mail processing machine according to claim 1, wherein turned, filled envelopes are inserted into an outward delivery channel having a cyclically actuated outward conveying device.

6. Mail processing machine according to claim 5, wherein a base of the outward delivery channel contains a deflection plate that is selectively opened under control in order to divert an envelope that is to be separated out into a diverter channel.

7. Mail processing machine according to claim 1, wherein the envelope turning cylinder is connected to a drive of the mail processing machine via a clutch that is actuated under control, and wherein on the basis of a signal reporting the supply of an envelope that is to be separated out, the clutch is opened and the tongs of the envelope turning cylinder are held in the open position with a horizontal opening direction, so that the envelope to be separated out is conveyed through the opened tongs without being gripped by the tongs and is conveyed into a diverter channel.

8. Mail processing machine according to claim 7, wherein the conveyance from the envelope turning station into the diverter channel is carried out during a subsequent operating cycle by means of a respectively following gripper of the gripper chain.

9. Mail processing machine of claim 1, wherein each envelope is deposited on the envelope turning table with an address field side or envelope window side pointing away from the envelope turning table.

10. Mail processing machine according to claim 1, wherein a drive sprocket driving the gripper chain is coupled to a continuous drive output of a drive system of the mail processing machine via a clutch that is actuated under control.

* * * * *